United States Patent [19]

Lazaroff et al.

[11] 4,244,621

[45] Jan. 13, 1981

[54] SEATING MODULE AND BASE COMBINATION, AND METHOD OF ASSEMBLING SAME

[75] Inventors: Charles W. Lazaroff, Springvale; Dexter A. Littlefield, N. Berwick; George E. Libby, N. Waterboro, all of Me.

[73] Assignee: Hussey Manufacturing Company, Inc., North Berwick, Me.

[21] Appl. No.: 32,521

[22] Filed: Apr. 23, 1979

[51] Int. Cl.[3] ..... A47C 1/12

[52] U.S. Cl. ..... 297/218; 297/248

[58] Field of Search ..... 297/218, 232, 248

[56] References Cited

U.S. PATENT DOCUMENTS

| | | | |
|---|---|---|---|
| 3,397,011 | 8/1968 | Sklaar | 297/219 |
| 3,466,087 | 9/1969 | Motter | 297/232 |
| 3,531,579 | 9/1970 | Duckett et al. | 297/248 |
| 3,702,204 | 11/1972 | Tipton et al. | 297/248 |

*Primary Examiner*—Francis K. Zugel

[57] ABSTRACT

A multiple seating arrangement and method of assembling same is provided comprising a base on which is mounted a continuous series of hollow seat modules in over-lapping, generally contiguous relation, each module having a fastening strip at its end. A first module is secured to the base at one end by its fastening strip and at the other end by barbed (or other type) fasteners secured to the base. Succeeding modules are secured at one end over the fastening strip of the previous module in such a way as to cover the securing means passing through the fastening strip into the base. A final module is made up by removing the fastening strip of a module, placing it under the end from which the fastening strip was removed, and using part of it there to secure that end to the base by means of a barbed fastener.

12 Claims, 12 Drawing Figures

SEATING MODULE AND BASE COMBINATION, AND METHOD OF ASSEMBLING SAME

FIELD OF THE INVENTION

This invention relates to multiple seating, and more particularly to seating modules for attachment to bases to provide continuous rows of seats for stadiums, theaters and other similar forms of multiple seating, although in some instances the modules can also be used in lesser numbers and even in single or double applications. The invention also relates to the method of assembling same.

BACKGROUND OF THE INVENTION

Traditionally stadium seating has comprised long rows of wooden planks, usually 9½" in width, mounted on various types of bases. Besides being notoriously uncomfortable, such seating has numerous other drawbacks. For example, with a typical wood or metal bench one cannot tell where his assigned seat is located, particularly if people are seated on the numbers or if the numbers are obsecure as is often the case. As a result, the occupants usually shift unevenly along the bench such that too many or too few people may occupy a bench, or some people may be crowded while othes are not. Wooden bench seats are also prone to wear, splintering, water soaking and/or rotting to say nothing of being carved upon. Also the fastening elements are subject to oxidation. A further, and sometimes serious, drawback of the wooden bench-seat is vandalism, particularly in the aftermath of an intense contest which may stimulate such activity. Thus, wooden bench-seats, unfortunately, can be ripped up and then turned into weapons, or firewood depending upon the needs and desires of the users.

A numer of attempts have been made to solve these and related problems. For example, it has been suggested to cover the wooden planks with cushioning material and to then cover the cushioning material with a heavy, tough plastic cover, or, in the alternative, to replace the wooden planks with metal channels of similar shape (See U.S. Pat. No. 3,025,104). Covering the planks with molded plastic elements without cushioning therebetween has also been suggested (U.S. Pat. No. 3,397,011). These suggestions helped preserve the wood, but they did not provide solutions to the other problems. Molding plastic covered seats as individual modular units, with each unit designed to accommodate a single person, and attaching them side by side to each other or to a base to form a continuous row of seats has also been suggested. (U.S. Pat. Nos. 3,012,818, 3,466,087). Such constructions satisfy the need for regular demarcation of assigned seats, but they are expensive and difficult to install. Other prior suggestions include providing stamped metal or molded plastic portable modular seat units adapted to being placed over conventional seating and having a compound curved shape for improved comfort, (U.S. Pat. Nos. 2,970,638, 3,466,087). In addition various ways to connect such individual seating modules to each other and/or to a base to form continuous rows thereof have been suggested including the use of (a) attaching flanges bolted or soldered together (U.S. Pat. No. 1,978,494); (b) tie bolts (U.S. Pat. No. 3,012,818); (c) separate connecting members which fit over and clamp the adjacent ends of the modules (U.S. Pat. No. 3,466,087); (d) screws or bolts (including "tamper proof" heads) through the front walls or underneath surfaces of the modules (U.S. Pat. Nos. 3,298,045 3,397,011, 3,531,157), or through the clamping members (3,466,087).

While some of these suggestions have provided the desired comfort, and others have adequately protected the underlying base, they have all been relatively expensive to construct and install, and none has provided completely hidden fasteners as distinguished from exposed "tamper-proof" bolt or screw heads. Another draw-back of the prior modular seat constructions is that their connecting components provide only a single fixed spacing. Thus, the installer in the field cannot vary the spacing between seat centers to make the units fit symmetrically to underlying bases of varying dimensions.

Accordingly, a basic object of this invention is to provide a simple, inexpensive seating module which will, at one and the same time provide (a) an adequate protective cover for an underlying base, (b) an improvement in seating comfort, (c) optional spacing between seat centers, and (d) a substantially tamper proof construction in which the connecting elements are not exposed to view. A further object is to provide such a module in which the interconnecting elements are part of a single basic structure, such that no separate connecting components need be provided, other than screws, bolts or barbed fasteners, whereby manufacturing and installation costs may be held to a minimum.

BRIEF DESCRIPTION OF THE INVENTION

In the accomplishment of these and other objects of the invention, in a preferred embodiment thereof, a multiple seating arrangement is provided in which a number of hollow seat modules are secured to a base to form a continuous row. The modules are made of highly durable plastic by blow molding and their upper surfaces are contoured, approximately to the shape of a person, for improved comfort. The underneath surfaces are contoured to provide both ventilation between the module and the underlying base, and support for the upper surface when the upper surface is depressed by the weight of an occupant of the seat. Each module is provided with a fastening strip at one end which fastening strip serves to secure one end of the module to the base by means of conventional fasteners. The first module of a row is secured to the base by cutting off the fastening strip of another module and using a part of the cut-off fastening strip to anchor two or more barbed fasteners on the base at the end of the base. The end of the first module is then pressed down onto these barbed fasteners. Next, barbed fasteners are placed in position in the fastening strip of the first module after which that fastening strip is affixed to the base by nails, screws, or the like. Next a second module is pushed down onto the barbed fasteners in the nailing strip of the first module, barbs are placed in its own fastening strip which is then nailed or screwed down. The process is then continued until the end of the underlying base is reached but for one module width, at which point the original module from which the fastening strip was severed to start the row, is used to finish off the row. This is done by using the remaining part of its severed fastening strip to anchor a set of barbed fasteners at the end of the row. The final module is then installed by pressing it down on barbed fasteners at both of its ends.

It is a feature of the invention that holes and/or indentations are punched or molded into the underneath surface of the modules to facilitate accurate placement of the fastening screws and/or barbed fasteners as well as accurate registration therewith of the holes adapted to receive the barbed fasteners.

An important feature is that all heads of fasteners are covered, thereby assuring substantially complete tamperproofness.

Another important feature is that the fastening strip is elongated and provides for variation in spacing between seat centers at the election of the installer in the field.

Still another feature is that the barbed fasteners may be plastic, and are adapted to accommodate enough lateral shifting between modules to account for all normally occurring differences in dimension between the base and the modules due to changes in ambient conditions.

In essence the basic features are (a) improved comfort, (b) a high degree of protection for the underlying base, (c) material cost reduced to a virtual minimum, (d) extremely simple installation, (e) highly effective tamper-proofness, and (f) versatility of spacing; all accomplished within a minimum of extra space, and with a highly durable construction. The result is to prolong the useful life of existing seating, or to provide durable new seating, in an inexpensive way as to both initial manufacture and subsequent installation.

BRIEF DESCRIPTION OF THE DRAWINGS

Several embodiments of the invention are illustrated in the accompanying drawings in which.

DESCRIPTION OF THE ILLUSTRATIVE EMBODIMENTS

Figure 3:
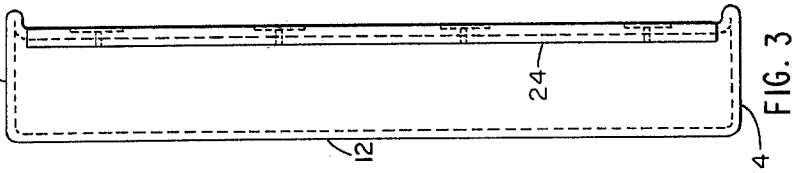
FIG. 3 is a view in end elevation of the module of FIG. 1.
Figure 1:
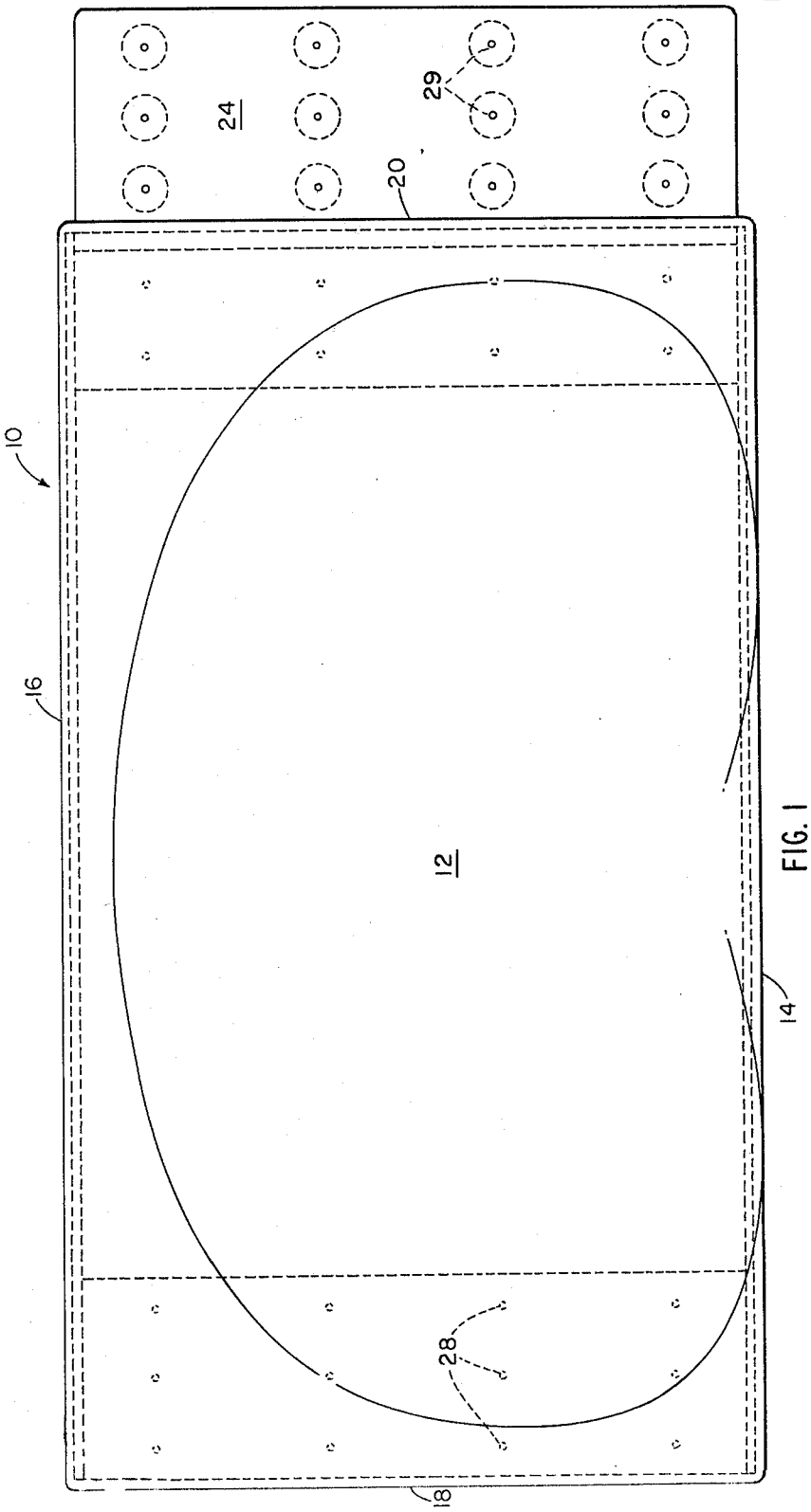
FIG. 1 is a plan view of a seating module made according to the invention.
Figure 2:
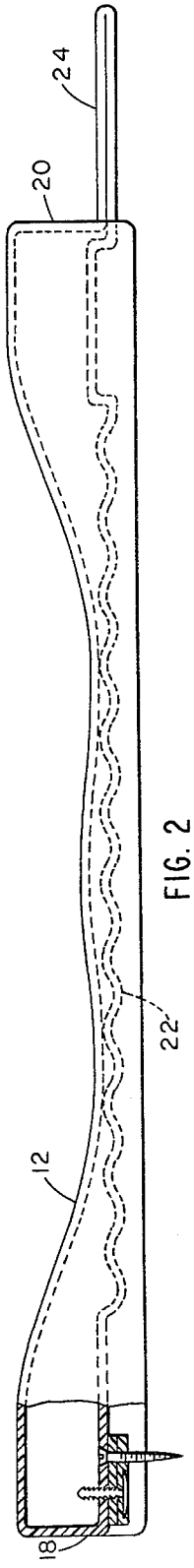
FIG. 2 is a view in front elevation of the module of FIG. 1.
Figure 6:
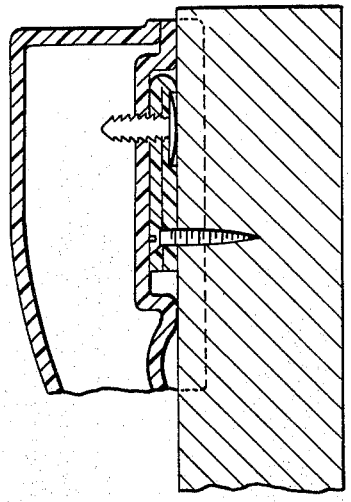
FIG. 6 is a cross-sectional view in front elevation showing how end modules are secured.
Figure 5:
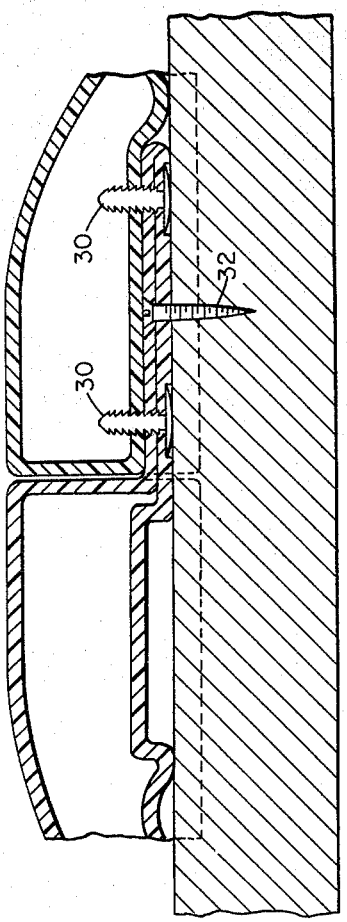
FIG. 5 is a cross-sectional view in front elevation showing how the fastening strip is attached to the base and how the barbed fasteners hold down the end of an adjacent module.
Figure 4:
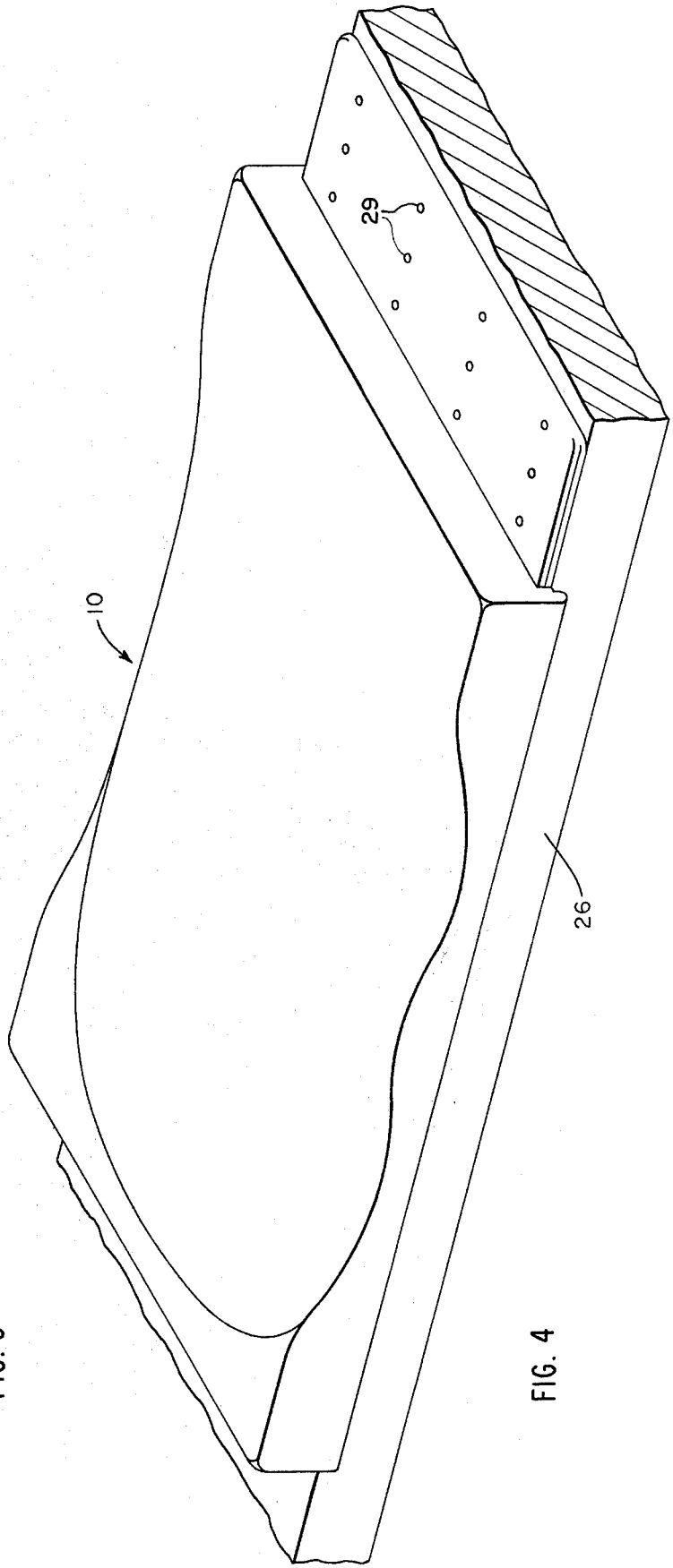
FIG. 4 is a perspective view of the module of FIG. 1 in position on an underlying base.

The first illustrative embodiment of the present invention is shown in FIGS. 1 to 6. It comprises a hollow, blow-molded seat module 10 of extremely tough, durable, and inert polyethylene-type, thermoplastic material. This material is extremely effective in the present context because it blow molds with ease. It can be made in a wide variety of attractive colors, and it can be given any desired matte, or simulated grain surface. In addition it resists stain, is impervious to and does not absorb moisture, and it is easily cleaned. Also it resists scratching, is extremely difficult to carve and does not sustain combustion under normal ambient conditions. In other words it provides an ideal material for use in stadium seating.

The module is flat, generally rectangular in shape and has an upper surface cavity 12 which is contoured to the form of a seat. The module 10 is bordered in the front by a generally vertical front face 14, in the rear, by a similarly vertical rear face 16, and by end portions 18 and 20. Completing the module is an underneath surface 22 which terminates at end portion 20 with a horizontally extending fastening strip or component 24. The front and rear faces 14 and 16 extend downwardly so as to cover or partially cover the front and rear faces of an underlying base 26.

The mid area of the underneath surface 22 is corrugated both to provide rigidity of construction and ventilation between the module and an underlying wooden base 26. In addition, at each end of the module the underneath surface 22 is indented at 28 to indicate appropriate locations for barbed fasteners 30, as will be further described.

The fastening strip 24 is also indented at 29 suitable for placing barbed fasteners 30 in registration with indentations 28.

Modules 10 are installed in the following manner. The fastening strip 24 of a module is cut off flush with the face of end portion 20. Cutting may be done in the field with a hot blade, hot wire or sabre saw. Due to welding of the polyethylenetype material at the junction, a clean, impervious seam is formed. The severed portion of the fastening strip is now cut longitudinally into two equal fastening strip halves, and barbed fasteners 30 are inserted in holes drilled in one of the fastening strip halves at the indentations 29 thereof. Now the severed fastening strip half, with barbs 30 in it pointing upwardly is affixed to the base as by screwing it thereto in position near the end of the base. At this point, indentations 28 of a first module at its end portion 18 are punctured at locations corresponding to the barbs 30 mounted on the half fastening strip secured to the end of the base as described. Also, appropriate holes are cut punctured at indentations 29 in the fastening strip 24 of the first module both for barbs 30 and for screws 32 and barbs 30 are inserted. Now the first module is ready for attachment to the base. This is one by pressing its end 18 down onto the barbs at the end of the base (see FIG. 2 left hand), and by screwing or nailing fastening strip 24 to the base leaving the barbs 30 in it pointing upwardly and ready to receive end 18 of another module. A second module is installed by puncturing its identations 28 and 29 of modules, where appropriate, installing barbs in the holes at 29, pressing end 18 of the second module down onto the barbs in the fastening strip of the first module, and affixing the fastening strip 24 of the second module to the base. Succeeding modules are installed in the same way. When a row is nearly completed, and there remains room for only one more module on the base, the row is completed by affixing to the base the original module from which the fastening strip 24 had been removed. This is done by puncturing holes 29 in the remaining half of the severed fastening strip 24, placing barbs 30 in them, pointing upwardly, puncturing holes 28 in the module at both its ends 18 and 20 to receive the barbs, affixing the remaining severed half of the fastening strip to the end of the base (with barbs 30 appropriately located relative to the barbs 30 in the fastening strip 24 of the next ahead module to fit the punctured holes in the undersurface of the module), and pressing the end module down onto the barbs at both ends 18 and 20.

Indentations 28 and 29, as shown in the drawings, are spaced to permit mounting the modules either at the minimum legal spacing between centers of 18", or greater.

The barbed fasteners 30 are made of a hard, tough, and slightly resilient plastic and are of the form now widely used in the automotive industry to interconnect many components. Although they provide a very secure and tight connection, their resilience also permits sufficient relaive motion between modules to accommodate dimensional differences between the modules and the base due to variations in ambient conditions.

The mid-area of undersurface 22 of the modules is lightly corrugated to provide a slightly resilient added support for the upper surface 12, and also to provide ventilation between the modules and the base. In addition, the undersurface 122 is indented at its ends 18 and 20 to receive the fastening strips 24 or portions thereof with the indentation at end 18 providing access above the base level from the end, while the indentation at end 20 does not provide such access. Drain or weep holes (not illustrated) are provided in the modules in the conventional manner. Seat number plates may be placed in the front faces 14 of the panels in the recessed area or row letters in a recess at one of its end portions 18 or 20 in position where a person seated on the module will not readily block the line of sight thereto.

Figure 8:
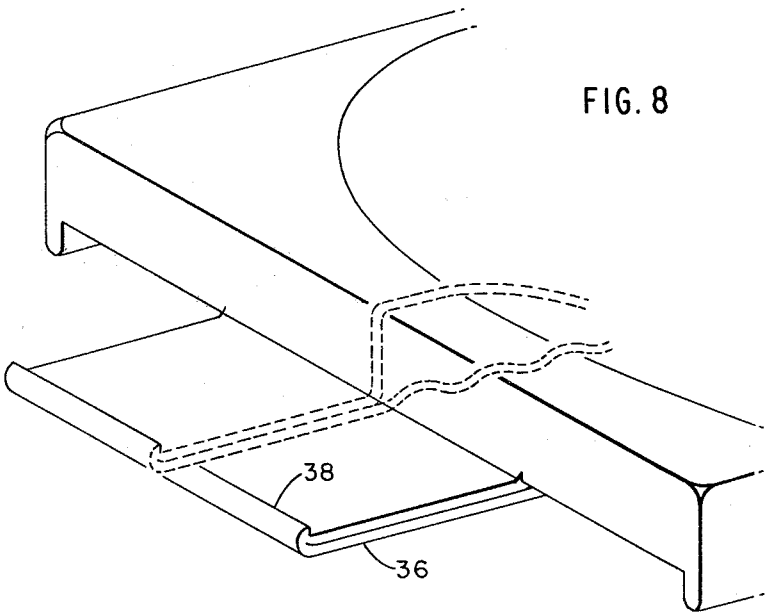
FIG. 8 is a view in perspective of the other end of the embodiment of FIG. 7.
Figure 7:
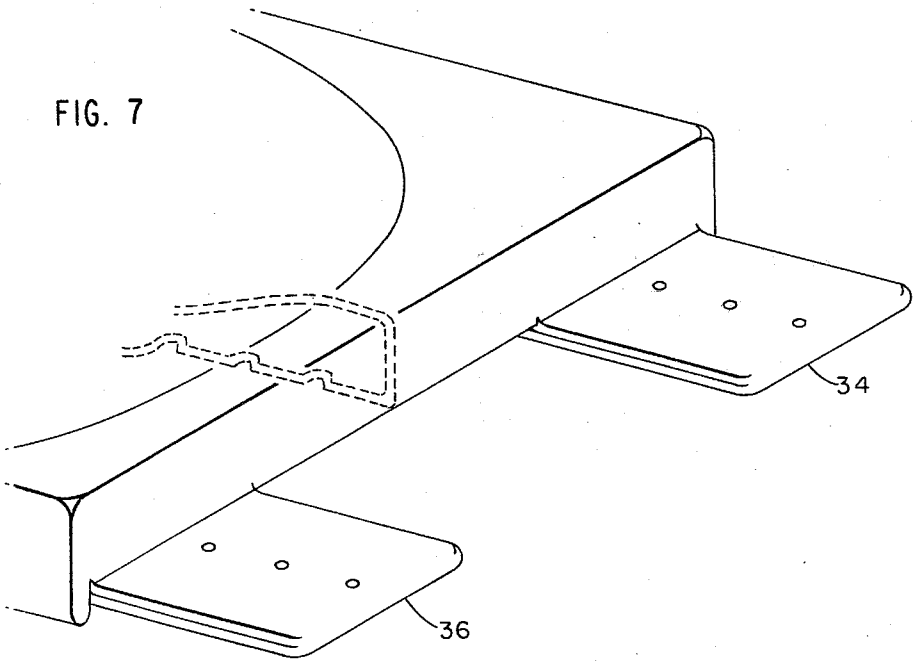
FIG. 7 is a view in perspective of one end of another embodiment of the invention wherein a locking tongue is employed to connect one end of each module to the module next ahead of it.
Figure 9:
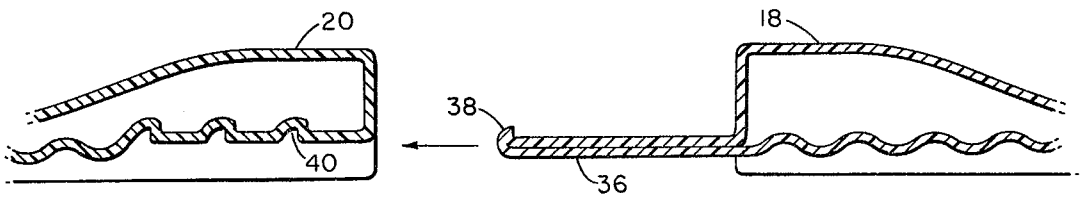
FIG. 9 is a view in front elevation showing how the locking tongue of the embodiment of FIGS. 7 and 8 works.

An alternative construction is shown in FIGS. 7 to 9 in which a pair of fastening strips 34 are used to attach ends 20 of the modules to the base, and a locking tongue 36 is used to connect end 18 of each module to end 20 of the next ahead adjacent module. In this instance, locking tongue 36 is provided with an upstanding barb 38 which fits into complementarily shaped indentations 40 in the undersurface 22 at end 20 of each module. Barbs 38 and indentations 40 have mating vertical surfaces which provide a firm interlocking relation, the operation of which is illustrated in FIG. 9. The first and final modules with this embodiment are installed in a similar manner to the modules of FIGS. 1 to 6 except that both of the attaching strips 34 are severed from the final module, and both are cut into two pieces and each half of each serves at the ends of the row for anchoring the first and final modules. In addition locking tongue 36 must be removed from the first module of the row. It can then be placed in the gap of the end module at the other end of the row so as to fill up an otherwise disadvantageous opening along the bottom line thereof.

Figure 10:
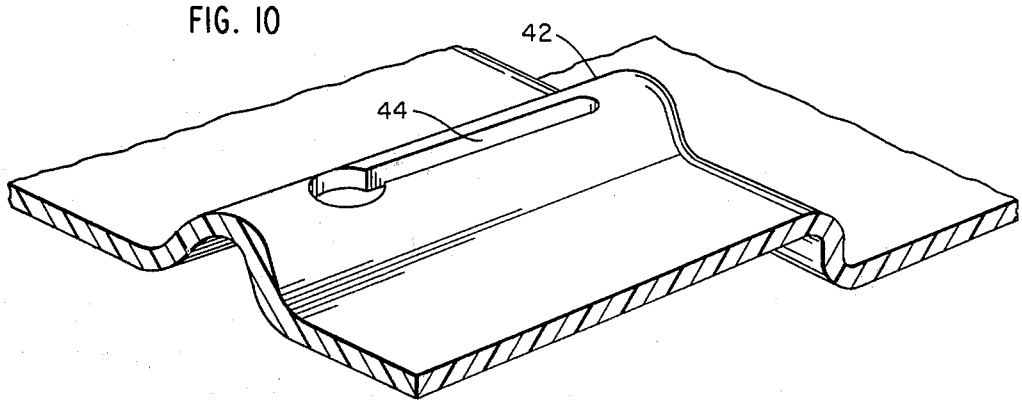
FIG. 10 is a view in perspective showing a keyhole slot arrangement for use in interconnecting modules of the type of FIG. 1.
Figure 11:
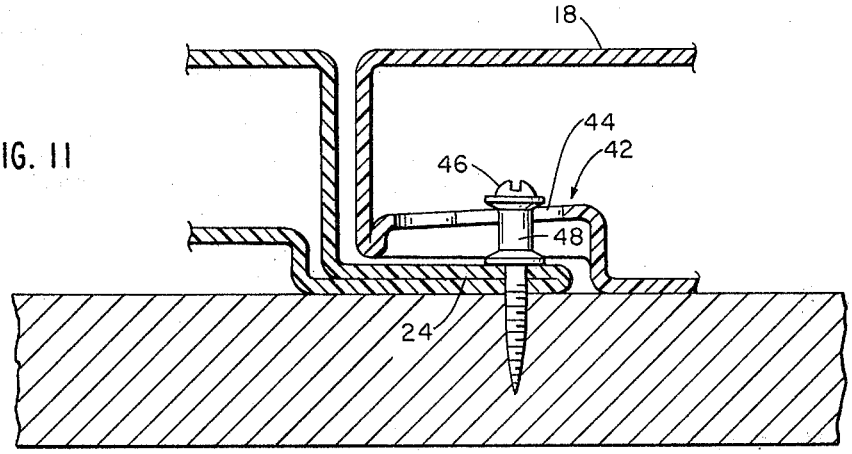
FIG. 11 is a cross-sectional view in front elevation of the keyhole slot embodiment of FIG. 10.
Figure 12:
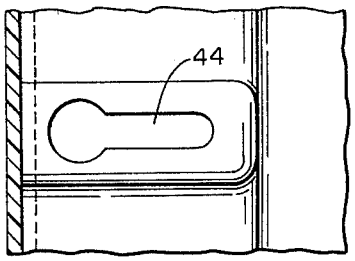
FIG. 12 is a plan view of the keyhole slot arrangement of FIG. 10.

In another variation, the barbs 30 which interconnect two adjacent modules in the embodiment of FIGS. 1 to 6 are replaced by a single fastener and key-hole slot arrangement. In this variation, shown in FIGS. 10 to 12, the underneath surface of the module at end 18 is provided with three upstanding molded ribs 42 at substantially the same locations as indentations 28 of the embodiment of FIGS. 1 to 6. Each rib 42 has in it a keyhole slot 44 in which the enlarged, hole portion is located nearest to the face of end 18. In this embodiment the fastening strip 24 is the same as in the embodiment of FIGS. 1 to 6. The modules are secured, however, with a single screw and sleeve arrangement. Securing adjacent modules within a row will be described first. It is done first by affixing the fastening strip 24 of one module to the base by a screw 46 carrying a double flanged collar or sleeve 48. In order to assure uniformity of spacing, the screw 46 is drilled through one of the indentations 29 of fastening strip 24. The next module is now installed by placing it over screws 46 so that the flanged sleeves 48 enter the keyhole slots 44. Next the module is pushed toward the already installed module to seat the flanged sleeves 48 in the slots 44. In order to ensure a tight fit, ribs 42 are given a slight rise from left to right as shown, and the flanged sleeves 48 are dimensioned in relation thereto to ensure that the plastic is under compression when the sleeves 48 are fully lodged in the slots 44. The start of a row is accomplished by severing a portion of the fastening strip of the intended final module of the row and using it to anchor a set of screws 46 and sleeves 48 at appropriate locations at the starting end of a row. The first module is then placed thereon and pushed laterally to fully seat the sleeves 48 in slots 44 thereof. The final end of the row is secured to the base with barbs 30 in the same manner as for the embodiment of FIGS. 1 to 6 and need not be described.

The embodiments of FIGS. 7 to 12 have the advantage that only one set of fastening elements in needed to install adjoining modules. In addition, removal is more convenient with the embodiments of FIGS. 7 to 12. Therefore, if the modules of a row need to be removed, as for example, in order to replace a damaged module or to change the seat spacing, such removal is facilitated by the embodiments of FIGS. 7 to 9. Release of the modules of FIGS. 10 to 12 within a row only requires backing off the screws and pulling the modules to free the flanged sleeves 48 from keyhole slots 44. Release of the modules of FIGS. 7 to 9 requires backing off the screws and then using a tool to lift ends 20 sufficiently to free barbs 38 of tongues 36 from locking engagements with indentations 40.

It will now be seen that the modules herein described may be installed singly or in doubles as well as in continuous rows of more than two modules. When installed singly, the attaching strip 42 is severed, cut in two and then used to mount barbs 30 for securing the module to the base by barbs 30 at each of its ends. In a double module situation the first module is mounted in the usual way for a first module and the second module has its attaching strip removed and is used as the end module.

Various other variations of the embodiments herein shown will now be apparent to those skilled in the art. For example, attaching the fastening strip 24 to the base can be done by means of a metal or plastic strap which encircles the base and covers the strip. In addition, the fastening strip 24 need not be integrally molded to end 20, but can be a separate component secured to end 20 by a second set of barbed fasteners. Various other similar modifications come within the spirit of the invention and therefore, our intention is not to confine the invention to the precise forms herein shown, but rather to limit it in the terms of the appended claims.

We claim:

1. A multiple seating combination comprising; a base and a multiplicity of seat modules mounted on said base and arranged in a row;

each said module comprising a hollow body member of generally shallow, flat, rectangular shape having an upper surface and an underneath surface, the upper surface contoured to the form of a seat; said body member also having generally vertical front and rear faces, and first and second end portions;

means for securing the first end portion of a first module to said base;

means for securing the second end portion of said first module to said base comprising a fastening component extending laterally from said second end portion integral with said underneath surface and said second end portion a fastener for securing said fastening component to said base, and a fastening head penetrating through said fastener component.

means for securing the first end portion of a second said module to said fastening head in position covering the fastener which secures the fastening component of the first said module to said base;

means for securing the second end portion of the second module to said base in the same way as the second end portion of the first module is secured;

a succession of such modules secured one after the other in substantially the same way as the second module is secured relative to the first;

an end module substantially identical to the modules already defined;

means for securing the first end portion of the end module to a fastening head penetrating the fastening component of the next to last module in position covering the fastener of that component; and means on said base and penetrating the underneath surface of the body of said end module for securing the second end portion of said end module to said base;

whereby a complete, substantially tamper-proof row of said modules covers said base.

2. The combination defined in claim 1 further characterized by:

said base comprising a horizontally extending wooden plank having a front and rear face, and the front and rear faces of said modules extending downwardly over and at least partially covering the front and rear faces of said plank.

3. The combination defined in claim 1 further characterized by:

the means for securing the first end components of said modules comprising barbed fasteners.

4. The combination defined in claim 3 further characterized by:

pre-cut means in said underneath surface for receiving said securing means, and pre-molded means in said fastening components positioning said securing means in precise registration with said pre-cut means.

5. The combination defined in claim 3 further characterized by:

said underneath surface and said fastening component perforated to receive said securing means in precise mutual registration.

6. The combination defined in claim 1 further characterized by:

said components being blow molded.

7. The combination defined in claim 1 further characterized by:

the means for securing the first end portion of the second module connected to the first module.

8. A method for assembling the multiple seating elements defined in claim 1 on a base which method consists in the steps of:

(1) affixing a first fastener having an exposed head to said base, (2) affixing a first end of a first module to said exposed head of said first fastener, (3) affixing a second end of said first module to said base by a second fastener having an exposed head, (4) affixing a first end of a second module to the exposed head of said second fastener; and (5) affixing succeeding modules onto exposed heads of fasteners by repeating steps (3) and (4).

9. A method for assembling the multiple seating elements defined in claim 1 on a base, which method consists in the steps of:

(1) affixing a first set of barbed fasteners to the base at one end, pointing upwardly, (2) affixing a first end of a first module onto said first set of upwardly pointed barbed fasteners, (3) affixing a second set of upwardly pointing barbed fasteners to the laterally extending fastening component of said first module, (4) affixing the fastening component of said first module to said base, (5) affixing a first end of a second module onto said second set of upwardly pointed barbed fasteners, (6) affixing succeeding modules onto barbs and attaching strips to said base by repeating the steps of (2) to (5) above, and (7) affixing the final end of a final module of a row to said base by means of a set of barbed fasteners secured to the base.

10. A multiple seating combination comprising; a base and a multiplicity of modules mounted on said base, arranged in a row:

each module comprising a body member having upper and underneath surfaces, also having at least one horizontally extending attaching strip at a first end of said body, and a horizontally extending locking tongue at a second end of said body;

means for affixing a plurality of said modules to said base including means for affixing said attaching strips to said base and means associated with the first ends of said modules for receiving the locking tongues of second ends of like modules in locking engagement, fastener means connected to said base at each end thereof having upstanding fastening heads, and means at the underneath surface of end modules of a row thereof for receiving said upstanding heads of said fastener means in locking engagement.

11. The multiple seating combination defined in claim 1 further characterized by:

means for attaching said second end portions of said modules to said base comprising a flanged head connecting member secured to said base and a keyhole slot in the underneath surface of said second end with said flanged head fitting in and engaged in locking relation in said slot, and means associated with said flanged head connecting members for securing the laterally extending attaching component of said modules to said base.

12. A multiple seating combination defined in claim 11 further characterized by barbed fastener means for securing end modules of a row thereof to said base.

* * * * *